United States Patent [19]

Ruff

[11] 4,445,684

[45] May 1, 1984

[54] LEG STRETCHING MACHINE

[76] Inventor: Henry C. Ruff, One Crown St., Hyde Park, Mass. 02136

[21] Appl. No.: 399,475

[22] Filed: Jul. 19, 1982

[51] Int. Cl.[3] ..... A63B 23/04; A63B 21/12

[52] U.S. Cl. ..... 272/134

[58] Field of Search ..... 272/126, 127, 128, 134, 272/137, 143, 145, 70, 71, 72, 130, 116

[56] References Cited

U.S. PATENT DOCUMENTS

| | | | |
|---|---|---|---|
| 902,946 | 11/1908 | De Nise | 272/126 |
| 3,834,694 | 9/1974 | Pridgen | 272/118 |
| 4,046,373 | 9/1977 | Kim | 272/63 |
| 4,111,415 | 9/1978 | Reitano | 272/94 |
| 4,125,258 | 11/1978 | McArthur | 272/144 X |
| 4,132,404 | 1/1979 | Wilson | 272/146 |
| 4,139,193 | 2/1978 | Felber | 272/93 |
| 4,149,713 | 4/1979 | McLeod | 272/134 |
| 4,277,062 | 7/1981 | Lawrence | 272/126 |

OTHER PUBLICATIONS

Black Belt, 5/1980, The GI Advertisement.

Black Belt, 2/1982, p. 17, Hurley Stretch Rack.

*Primary Examiner*—Richard J. Johnson

*Attorney, Agent, or Firm*—John P. McGonagle

[57] ABSTRACT

A leg stretching machine comprises a seat fixed to one end of a shaft having a winch connected to slideably mounted spreader arms for splitting one's legs apart to stretch and develop leg muscles. The spreader arms are pivotally connected to a cylinder mounted on the shaft at the end opposite to the seat. The ends of the spreader arms not pivotally connected have pads. The padded ends of the spreader arms rest against the insides of the lower legs of the exerciser sitting in seat. The winch is used to pull the cylinder towards the seat. This causes the spreader arms to exert force against the insides of the exerciser's legs thereby spreading them. A ratchet device on the winch allows holding control at any leg split position. A hand grip is also mounted on the shaft between the seat and the spreader arm cylinder. This allows the exerciser to pull the upper body closer to the floor thereby simulating various martial arts positions.

5 Claims, 1 Drawing Figure

LEG STRETCHING MACHINE

BACKGROUND OF THE INVENTION

This invention relates to exercise and stretching devices and particularly to leg stretching exercise devices.

The prior art includes various patents pertaining to exercise devices but none of the devices, with one exception, are particularly suitable for stretching the legs for the martial arts, gymnastics, or ballet dancing. U.S. Pat. No. 3,638,939 to C. J. Langley discloses a simple bar-like device which includes rollers at each end thereof and an intermediate handle. The device is positioned between one's legs and pulled towards the abdomen forcing the legs further and further apart, then stretching the muscles associated therewith.

U.S. Pat. No. 3,834,694 to R. H. Pridgen relates to an apparatus utilizing pulleys wherein one leg is strapped to a mattress and the other leg is coupled to weights by an overhead pulley system. A rope is also coupled to the weights through a one-way clutch. The same patent further discloses a post which is gripped while one moves his legs back and forth against spring bars mounted to the post. Also in the same general area are U.S. Pat. No. 4,046,373 to C. C. Kim which discloses a multipurpose frame for stretching one's legs and U.S. Pat. No. 4,111,415 to A. Reitano which discloses utilizing hand grips and foot grips to develop particular muscles for karate.

U.S. Pat. No. 4,132,404 to R. L. Wilson discloses a leg stretching apparatus comprising two movable platforms having ball casters with free movement in opposite directions, said platforms being joined by an appropriate coupling means. U.S. Pat. No. 4,139,193 to D. P. Felber, et al, discloses a kick training aid for karate comprising an adjustable pole with a footpiece on the top thereof mounted for universal movement on a base, said pole being extensible to accomodate individuals of different heights.

Finally, U.S. Pat. No. 4,277,062 to M. Lawrence discloses a leg stretching exercising device comprising a platform attached to a bar with pulleys attached to each end. Each pulley contains a rope with a foot stirrup at one end for locking one's foot and a handle at the other end. The pulley handles are pulled stretching one's legs which are placed in the stirrups. This patent is the only one in the prior art which is particularly suitable for stretching the legs for the martial arts, gymnastics or ballet dancing.

In embodiments of the type known heretofore it is difficult to obtain a leg side-split as wide as 180 degrees. Prior embodiments generally require active physical involvement and cooperation of other parts of the body. This requires substantial upper body strength to obtain and hold a wide split. Other embodiments require active involvement of the legs in obtaining the split which causes leg muscles to counteract the stretching effect desired.

The present invention comprises a relatively inexpensive leg stretching device which requires only passive involvement of the legs and minimal involvement of other parts of the body. The device fits individuals of all sizes, permits splits of up to and over 180 degrees, allows precise and measured increases in split width, and can hold a given split indefinitely. The apparatus is light and portable.

Accordingly, an object of this invention is to provide a new and improved leg stretching exercise device.

Another object of this invention is to provide a leg stretching device which is inexpensive and easy to use wherein an individual's legs may be stretched into a split position.

A more specific object of this invention is to provide a new and improved leg stretching device which includes a seat fixed to a shaft having a winch connected to slideably mounted spreader arms for splitting one's legs apart to stretch and develop leg muscles.

BRIEF DESCRIPTION OF THE DRAWING

The accompanying drawing shows, by way of example, one embodiment of the invention wherein.

DETAILED DESCRIPTION OF THE INVENTION

Figure 1:
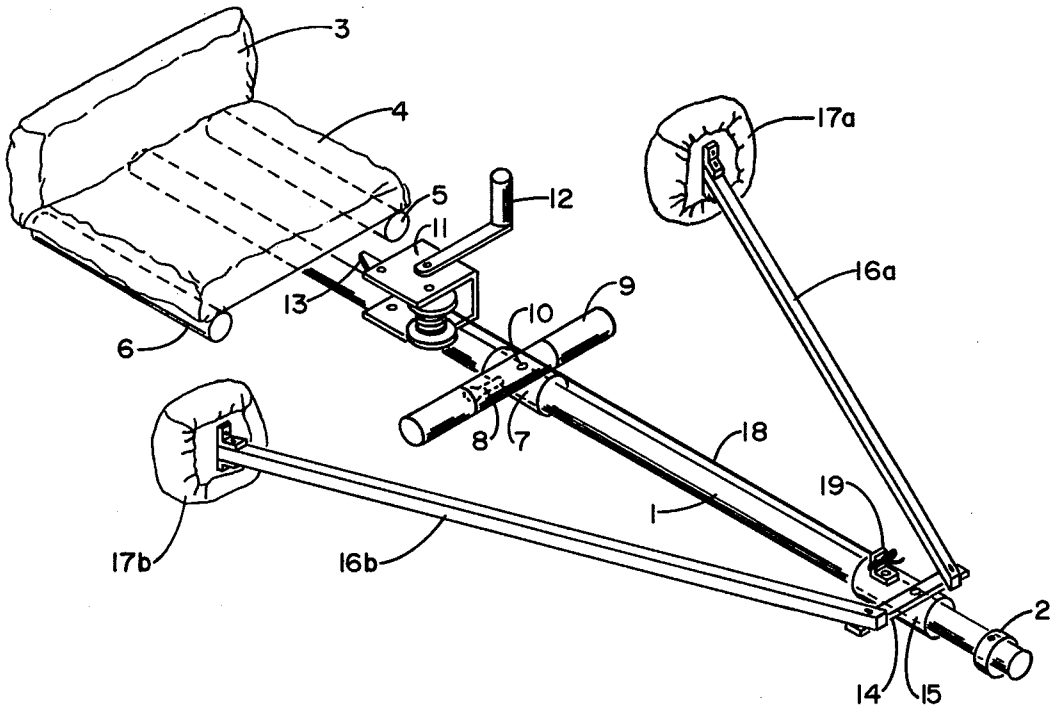
FIG. 1 is a perspective view of the leg stretching machine.

Referring now to the drawing, FIG. 1, the leg stretching machine comprises a shaft 1 running the length of the machine and having a forward end, a back end, a top side, and a bottom side. A stopping ring 2 is fixedly attached to the forward end of the shaft 1. A seat 4, with a back brace 3 and spaced support members 5 and 6, is mounted at the back end of the shaft 1 on the top side.

A hand grip 9 is attached to a cylinder 7 slideably mounted on the shaft 1 between the seat 4 and the stopping ring 2. The position of the hand grip cylinder 7 along the shaft 1 is variable and may be locked into place by means of an adjustment bolt 8. The axis of the hand grip can be varied by means of a second adjustment bolt 10 securing the hand grip 9 to the cylinder 7.

A winch assembly 11 with handle 12 and ratchet brake 13 is fixedly mounted to the shaft 1 and positioned between the seat 4 and the hand grip 9.

A close-bar 14 with two ends is attached to a cylinder 15 slideably mounted on the shaft 1 between the hand grip 9 and the stopping ring 2. Rods **16*a* and 16*b* are pivotally attached to each end of the cross-bar 14. Pads 17*a* and 17*b* are rotatably attached to the free ends of the rods 16*a* and 16*b*.**

A rope 18 is attached to an angle iron 19 fixed to the cross-bar cylinder 15 and connected to the winch assembly 11 so that the force exerted by the winch 11 can be directly translated to the cross-bar cylinder 15.

OPERATION

When the machine is in use, the pads **17*a* and 17*b* rest against the inside of the exerciser's legs. By turning the winch handle 12 the cross-bar cylinder 15 moves back along the shaft toward the seat 4. This movement of the cross-bar cylinder 15 causes the rods 16*a* and 16*b* to also move back thereby placing backward pressure on the exerciser's legs causing them to spread wider consequently increasing the split. The winch brake 13 allows the exerciser to hold position at any position for any length of time. An alternate embodiment would be to replace the winch brake 13** with a ratchet-brake assembly thereby giving automatic braking.

The seat back brace 3 holds the exerciser in place against the backward pressure on the entire body caused by the machine. The hand grip 9 allows the exerciser to pull the upper body closer to the shaft 1. This causes relaxation of the legs thereby helping spread the legs wider.

The machine may be folded for storage. The rods 16*a* and 16*b* are brought to a parallel position with the shaft 1. The winch 11 is released so that the pads 17*a* and 17*b* may be positioned against the front end of the seat 4. The winch 11 is then tightened so that the rods 16*a* and 16*b* are held in place by the backward pressure exerted by the winch 11 on the cross-bar cylinder 15. The hand grip 9 is loosened by means of the adjustment bolt 10 and positioned parallel to the shaft 1. The adjustment bolt 10 is then tightened to hold the hand grip 9 in place.

It is understood that the above-described embodiment is merely illustrative of the application. Other embodiments may be readily devised by those skilled in the art which will embody the principles of the invention and fall within the spirit and scope thereof.

I claim:

1. A leg stretching machine comprising:

a shaft having a top side, a bottom side, a front end, and a back end;

a seat attached on the top side at the back end of the shaft;

a winch mounted on the shaft between the seat and the front end of the shaft;

a cross-bar having a pair of ends slideably mounted on the shaft between the winch and the front end of the shaft;

a flexible connecting means between the winch and the cross-bar;

a pair of rods each having two ends, one end of which is pivotally attached to the cross-bar; and a pad means pivotally attached to the opposite end of each rod and each being adapted to engage a user's leg while seated on the machine whereby the user may operate the winch and draw the cross-bar toward him and thereby cause the pads to be forced against his legs.

2. A leg stretching machine in accordance with claim 1 further comprising:

a stopping ring mounted on the shaft between the cross-bar and the front end of the shaft.

3. A leg stretching machine in accordance with claim 2 further comprising:

a hand grip assembly attached to the shaft between the winch and the cross-bar.

4. A leg stretching machine in accordance with claim 3 whereas:

the winch includes a ratchet brake.

5. A leg stretching machine in accordance with claim 4 wherein:

the connecting means between the winch and the cross-bar is a rope.

* * * * *